United States Patent [19]

Daswick

[11] 4,143,165

[45] Mar. 6, 1979

[54] FOLDABLE PACKAGE FOR MEAT SANDWICH

[76] Inventor: Alexander C. Daswick, 647 Orange Grove, South Pasadena, Calif. 91030

[21] Appl. No.: 761,287

[22] Filed: Jan. 21, 1977

[51] Int. Cl.[2] ..... B65B 25/22

[52] U.S. Cl. ..... 426/113; 229/3.5 MF; 229/56; 426/115; 426/120; 229/DIG. 14

[58] Field of Search ..... 426/119, 120, 113, 114, 426/107, 234; 229/56, 3.5 MF

[56] References Cited

U.S. PATENT DOCUMENTS

| | | | |
|---|---|---|---|
| 2,633,284 | 3/1953 | Moffett et al. | 229/DIG. 14 |
| 2,674,536 | 4/1954 | Fisher | 426/114 |
| 2,705,579 | 4/1955 | Mason | 426/120 |
| 2,745,751 | 5/1956 | Pichardo | 426/120 X |
| 3,162,539 | 12/1964 | Nepko | 426/119 |
| 3,219,460 | 11/1965 | Brown | 426/114 |
| 3,465,873 | 9/1969 | Munz | 426/114 |
| 3,672,916 | 6/1972 | Virnig | 426/114 |
| 3,741,427 | 6/1973 | Doyle | 426/113 X |
| 3,873,735 | 3/1975 | Chalin | 426/114 X |
| 3,876,131 | 4/1975 | Tolaas | 426/113 |
| 3,997,677 | 12/1976 | Hirsch et al. | 229/DIG. 14 |
| 4,013,798 | 3/1977 | Goltsos | 426/107 |
| 4,051,266 | 9/1977 | Goltsos | 426/120 |

FOREIGN PATENT DOCUMENTS

| | | | |
|---|---|---|---|
| 1382148 | 8/1963 | France | 426/115 |

OTHER PUBLICATIONS

Quick Frozen Foods, 4/57, p. 68.

*Primary Examiner*—Steven L. Weinstein

[57] ABSTRACT

A metal foil container forming three generally rectangular compartments, each compartment being hingedly secured along one of its ends to an end of one of the other compartments, so that all of the compartments are foldable relative to each other.

The method of cooking and serving a hamburger sandwich in the same package in which it was refrigerated and stored, in which a package including separate compartments foldable relative to each other is first used for supporting two pieces of bread in spaced relationship to a meat patty while the meat patty is grasped between a pair of hot metal jaws for purpose of cooking it, utilizing the same package to conduct hot cooking gases from the meat patty to the bread, and again using the package to assist in folding the meat patty and pieces of bread into a sandwich concurrently with the disassembly and removal of the package.

4 Claims, 11 Drawing Figures

FIG. 5.
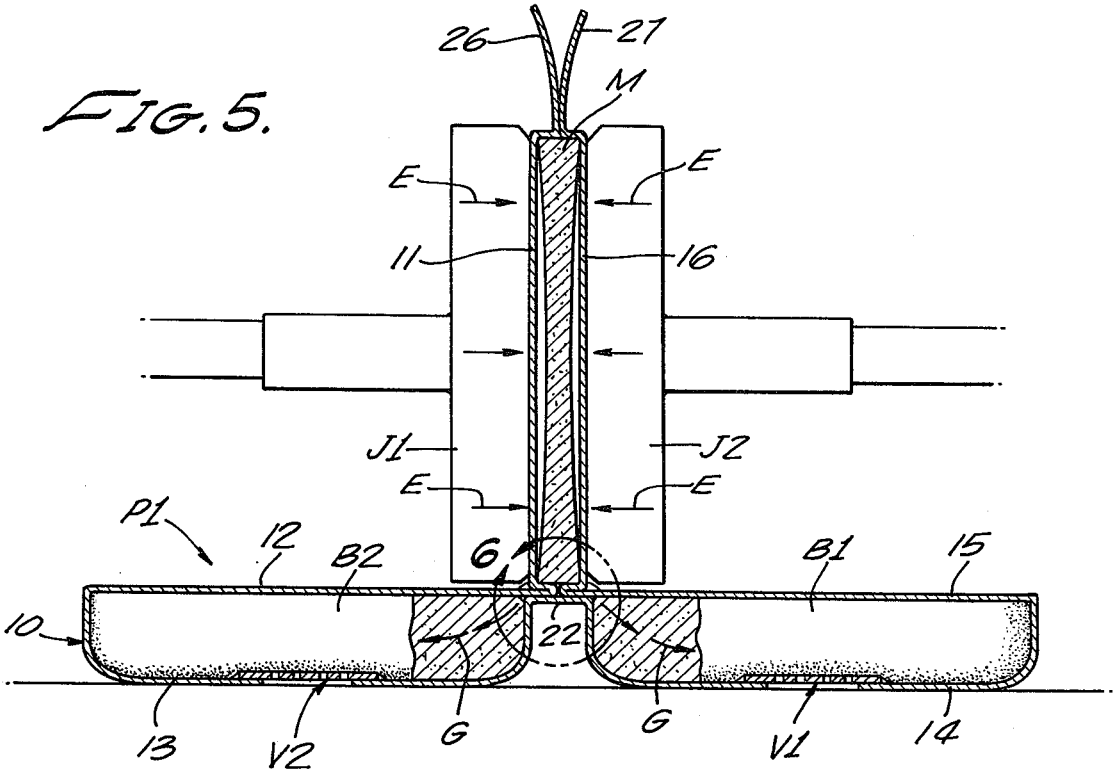
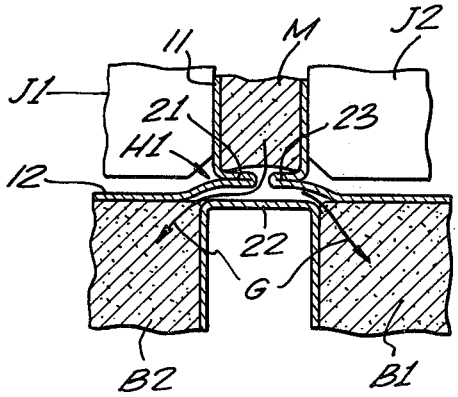
FIG. 6.
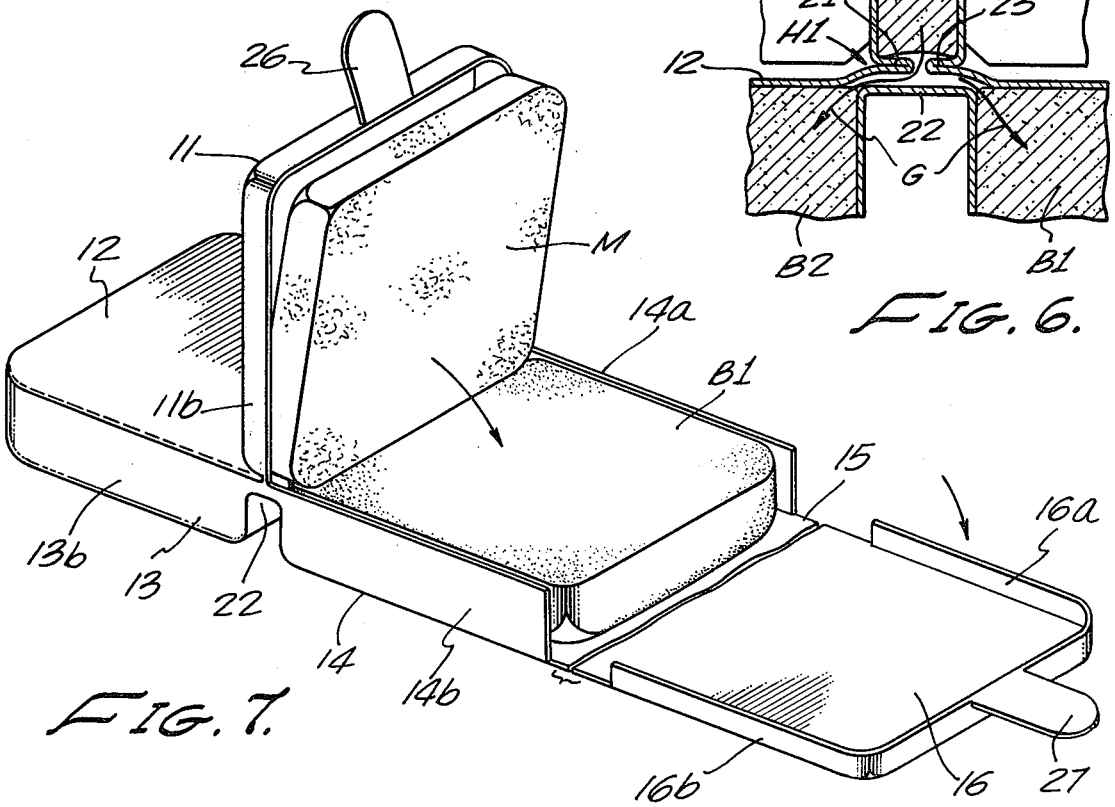
FIG. 7.

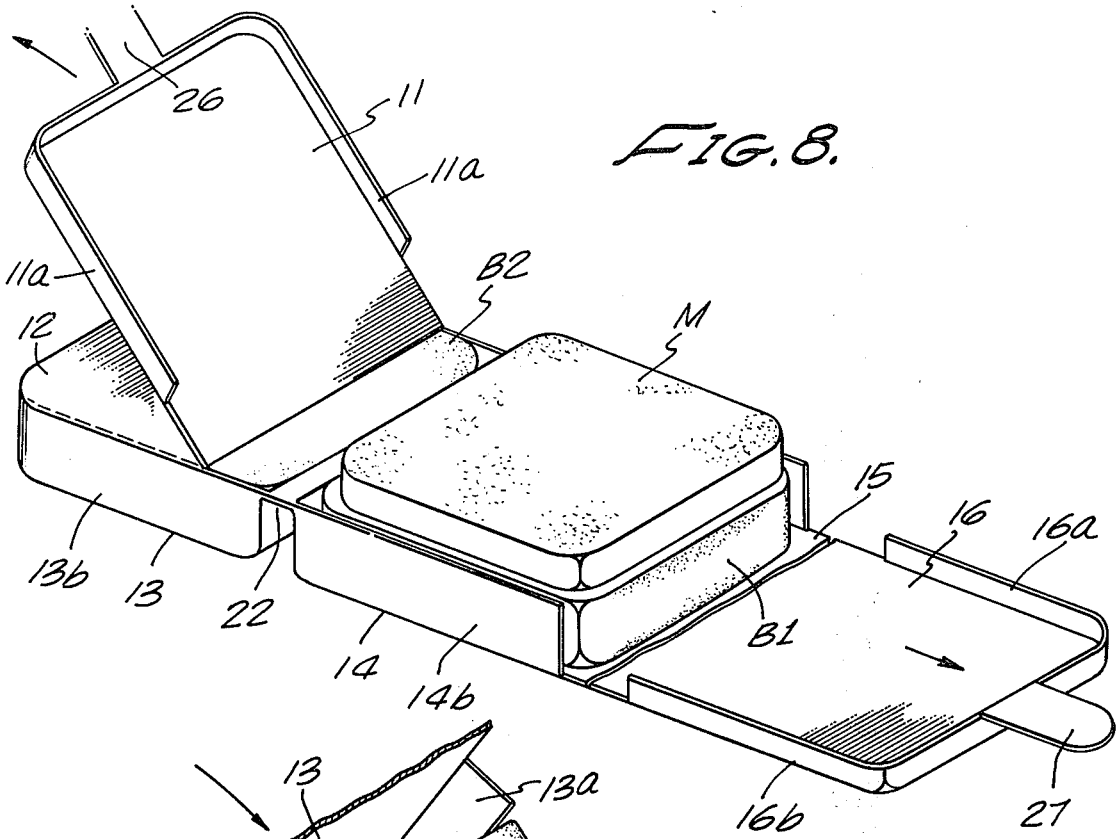
FIG. 8.
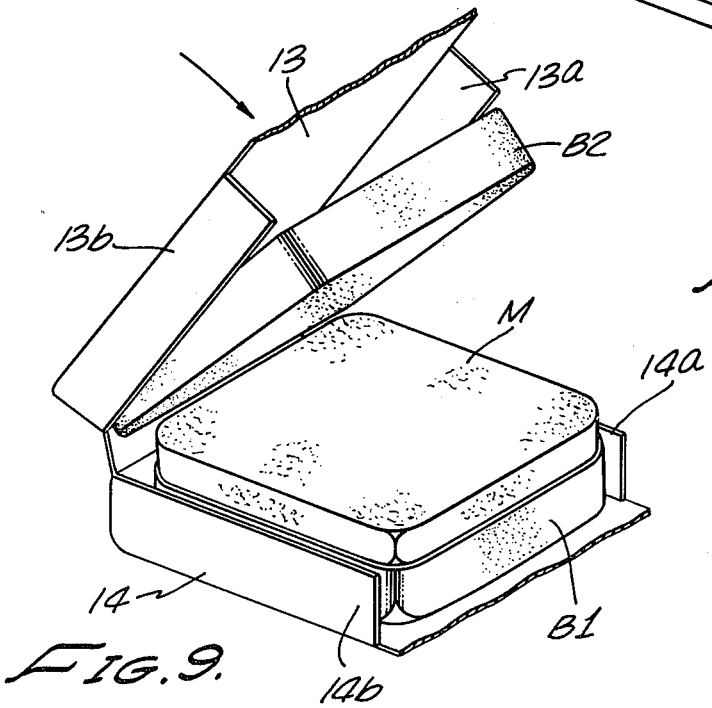
FIG. 9.
FIG. 10.
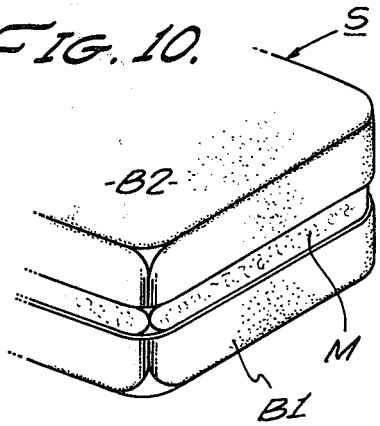
FIG. 11.
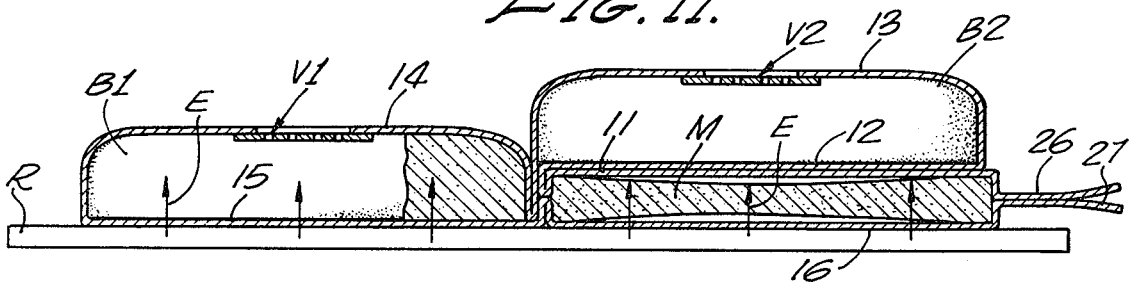

FOLDABLE PACKAGE FOR MEAT SANDWICH

RELATED APPLICATION

The present invention is an improvement over that disclosed in my copending application Ser. No. 654,712 filed Feb. 2, 1976.

BACKGROUND OF THE INVENTION

As pointed out in my prior copending application, there is a particular need for improved methods of packaging hamburger sandwiches and the like so that they may be conveniently cooked and served at mobile locations such as catering trucks.

Even if the sandwich is to be cooked and served in a restaurant or in the kitchen of a customer's home, it would be advantageous to utilize a single package for refrigerating, transporting, storing, cooking and serving the sandwich.

SUMMARY OF THE INVENTION

A metal foil package has three separate compartments which are hingedly joined together so that they are foldable relative to each other. A meat patty is placed in one compartment, and bun halves or other pieces of bread are placed in the other two compartments. A vent opening with a removable lid or cover is provided in at least one, and preferably both of the bread compartments. The hinged connections of the compartments are so constructed that gases may flow internally of the package from the meat patty compartment to at least one, and preferably both, of the bread compartments. When the package has been filled it is sealed, and the contents may then be refrigerated, shipped and stored.

The method of using the package at the point of consumption of the product is as follows. The vent covers are removed. The meat patty compartment is then held in spaced relationship to the bread compartments, and cooking heat is then applied to the meat patty, preferably by grasping the metal foil walls of the meat patty compartment between a pair of hot metal jaws. During cooking of the meat patty hot gases flow into at least one of the bread compartments and then escape to atmosphere. When the meat patty has been cooked, the package is utilized to assist the folding of the meat patty and pieces of bread into a sandwich, while concurrently disassembling the package and removing it from its contents.

According to the presently preferred embodiment of the invention the three compartments of the package are supported from a common hinge means, and are therefore arranged like the leaves of the book. The center compartment is used for the meat patty and the outer compartments are used for the bun halves. The package is then folded up like a book for purposes of refrigeration, shipment and storage.

DRAWING SUMMARY

FIG. 5 is a cross-sectional elevational view taken on the line 5—5 of FIG. 4, and showing the cooking jaws applied to the meat patty;

FIG. 6 is an enlarged fragmentary view taken within the circle 6 of FIG. 5;

FIG. 7 is a perspective view of the package when it has been partially opened;

FIG. 8 is another perspective view like FIG. 7 and showing partial assembly of the sandwich;

FIG. 9 shows the last step in assembly of the sandwich;

FIG. 10 shows the fully assembled sandwich with the package removed; and

FIG. 11 shows an alternate method of cooking the burger of FIGS. 1–10, with the package unfolded and placed on a grill.

PREFERRED EMBODIMENT

Figure 1:
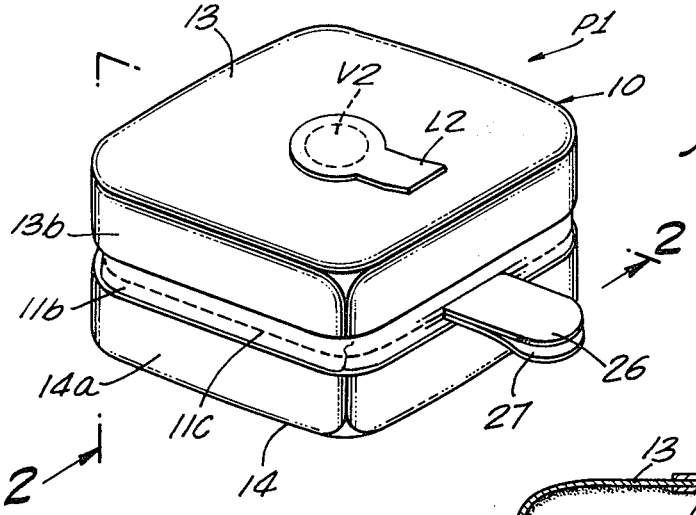
FIG. 1 is a perspective view of a first embodiment of the invention.

Reference is now made to drawing FIGS. 1 through 10, inclusive, illustrating the preferred embodiment of the invention.

Package P1 is made of a single elongated metal foil strip 10, whose length is transversely divided to form wall sections 11 through 16, inclusive, and whose ends form opening tabs 26, 27. Wall sections 11 and 16 are folded together to form the central compartment of the book, which receives a patty M. Wall sections 14 and 15 are folded together to form one of the side compartments which receives a bun half B1, while wall sections 12 and 13 are folded together to form another side compartment receiving a bun half B2.

Figure 3:
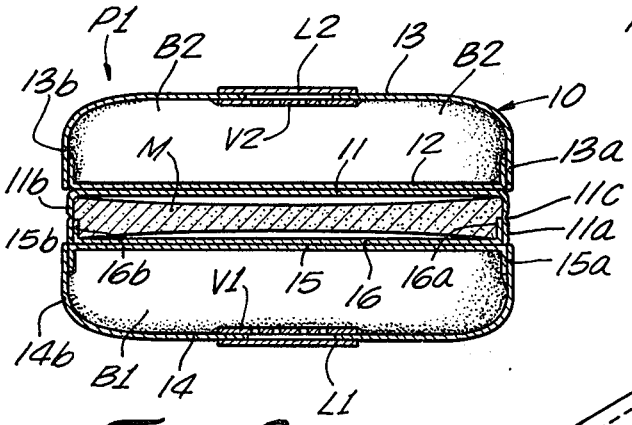
FIG. 3 is a cross-sectional elevational view taken on line 3—3 of FIG. 3.

The wall sections 11 through 16, inclusive, are flanged either upwardly or downwardly as necessary at their lateral side edges in order to form the desired compartments when the package is assembled. Thus as best seen in FIG. 3 the wall section 14 has upwardly turned side walls **14*a* and 14*b* which mate with downwardly turned side flanges 15*a*, 15*b* of the wall section 15**. The other compartments are constructed in a similar fashion.

Figure 2:
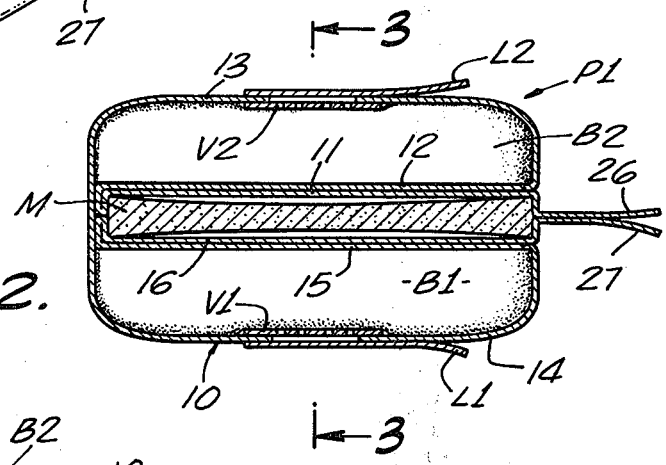
FIG. 2 is a cross-sectional elevational view taken on line 2—2 of FIG. 2.

FIGS. 1, 2, and 3 show the metal foil package when filled with the meat patty M and bun halves B1, B2, for purpose of refrigeration, shipment and storage. Bun half B1 is vented by a vent V1 formed in the wall section 14, the vent V1 being initially sealed by a removable lid or cover L1. In similar fashion the bun half B2 is vented by a vent V2 in the wall section 13, with vent V2 being covered by the removable lid L2.

Thus the metal foil strip 10 is in fact formed into a trough having side walls, but the wall sections 11 and 16 which provide the compartment for the patty M are shallower than the other portions of the trough, as will be evident from FIGS. 2 and 3. The hinged connections of the three compartments at their adjoining ends are provided by forming transverse depressions in the bottom wall of the trough, such as the depression 22 which is clearly seen in FIGS. 5 and 7. Depression 22 is formed between wall sections 13 and 14. A much smaller depression 21 is formed between wall sections 11 and 12, and another small depression is formed between wall sections 15 and 16. These depressions are best seen in drawing FIGS. 6. The hinge means thus formed for pivotally supporting the three compartments relative to each other at one of their ends is collectively identified as H1.

Figure 4:
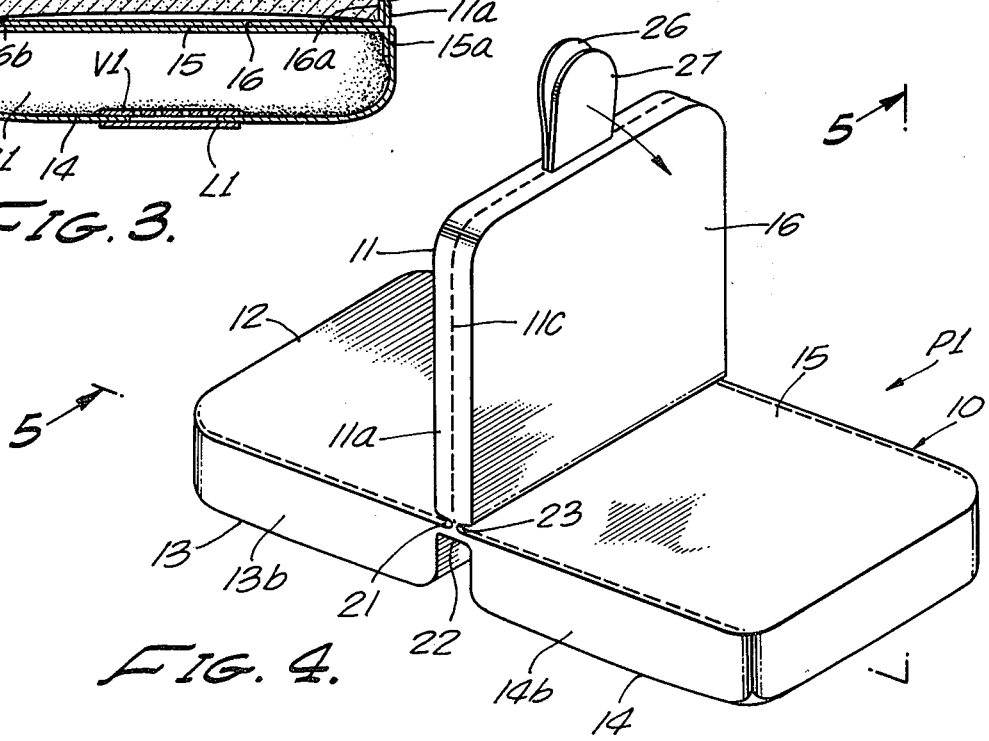
FIG. 4 is a perspective view when the package has been unfolded.

When the meat sandwich is to be cooked, the bread compartments are opened outwardly to an angle of about 180 degrees as shown in FIG. 4. The meat compartment is then fully exposed. The metal foil walls 11 and 16 of the meat compartment are then grasped between a parallel pair of hot metal jaws J1 and J2 as shown in FIG. 5. Cooking heat represented by arrows E flows from the jaws into the meat patty M. Cooking of the meat patty generates hot gases identified by arrows G, which flow through the hinge means H1 to warm and moisten the bun halves B1, B2 before escaping to atmosphere through vents V1, V2. Removable covers L1, L2 are of course removed at the time the meat patty is placed between the hot jaws. The enlarged detail drawing in FIG. 6 illustrates the flow of hot gases G from the meat patty M through the hinge means H1 to the bun halves.

After the meat patty has been cooked, the metal foil package is used to assist in folding the component parts of the sandwich to their assembled relationship. The first step is to pull the end tab 27 in order to remove wall section 16 from the meat patty M and wall section 15 from bun half B1. As shown in FIG. 3 the side walls 11*a*, ll*b* of wall section 11 are scored along a line 11*c*, the line 11*c* being illustrated in dotted form in FIG. 4. This scored line makes it possible to separate the meat patty compartment into two equal halves by separating the end tabs 26, 27. Pulling end tab 27 away causes meat patty M and bun half B1 to be exposed in the positions shown in FIG. 7 End tab 26 is then tilted over bun half B1 in order to dump the cooked meat patty M upon the bun half. This relationship is shown in FIG. 8. Then the end tab 26 is pulled in the opposite direction so as to remove the metal foil wall section 12 from its attachment to the side walls of the metal foil wall section 13 and thereby expose the bun half B2. After the wall sections 11 and 12 are pulled out of the way, wall section 13 is bent upward and over relative to the wall section 14, which is then resting upon a flat surface and supporting the bun half B1 and cooked meat patty M above it. Further movement of wall section 13 as shown in FIG. 9 causes the bun half B2 to be dumped on top of the meat patty M. This completes the assembly of the sandwich, and the package parts are then removed, leaving only the assembled sandwich S as shown in FIG. 10.

ALTERNATE METHOD

In using the package of FIGS. 1–10 it is preferred to cook the meat patty by grasping it between a pair of heated metal jaws, as previously illustrated and described. However, cooking of the meat sandwich may, if desired, be accomplished in accordance with the method shown in FIG. 11. There the meat patty M is left folded against the bun half B2 while the bun half B1 is folded outward in essentially 180 degree relationship to the meat patty. The entire package is then placed upon the surface of a cooking range R. Cooking heat indicated by arrows E flows upwardly into the bun half B1 as well as into the meat patty M.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A packaged hamburger sandwich adapted to be transported, stored, cooked and served in its original package, comprising:

a flexible metal foil container forming three generally rectangular compartments, one for meat and two for bread;

each of said compartments having opposed flat side walls, ends and sides;

a meat patty in said meat compartment;

two pieces of bread in corresponding bread compartments;

said three compartments having a common end forming a common hinge means such that they may be folded together into a transport or storage position with the flat side walls of said meat compartment being engaged by corresponding ones of said bread compartments, or alternatively they may be opened up into a cooking position such that the full rectangular area of both flat side walls of said meat compartment may be concurrently engaged by heat applying means;

said hinge means being so constructed as to permit cooking gases to flow internally therethrough between the compartments;

at least one of said bread compartments having a vent opening formed in an exterior wall thereof, and having a manually removable cover enclosing said vent opening;

whereby when said cover is removed and said compartments are opened up, and heat is then applied to the flat side walls of said meat compartment, cooking gases will flow from said meat compartment through said hinge means and past the associated piece of bread before escaping from said vent opening; and said container having a weakened tear line extending along the end of said meat compartment opposite said common end and also extending substantially continuously along both of said sides of said meat compartment and both of said sides of both of said bread compartments, such that after cooking is completed the flat side walls of said meat compartment may be pulled away from corresponding sides of the meat patty and at the same time the bread compartment walls may be pulled away from the pieces of bread which may then be folded towards the meat patty to form the sandwich.

2. A packaged hamburger sandwich as in claim 1 wherein a single continuous strip of metal foil forms both walls of all of said compartments, as well as said hinge means.

3. A packaged hamburger sandwich as in claim 1 wherein each of said bread compartments has a vent opening with a removable cover thereon.

4. A packaged hamburger sandwich as in claim 1 which also includes a pair of opening tabs on the unattached end of said meat compartment, each being formed integral with the associated side wall, and said weakened tear line being located between said opening tabs.

* * * * *